US007390009B2

(12) United States Patent
Trimble et al.

(10) Patent No.: US 7,390,009 B2
(45) Date of Patent: Jun. 24, 2008

(54) SKI WITH REPLACEABLE EDGE

(75) Inventors: Alan Trimble, Laguna Nigel, CA (US); Brian H. C. Smith, Newport Beach, CA (US); Julien Regnier, La Plagne (FR)

(73) Assignee: Armada Skis, Inc., Costa Mesa, CA (US)

( * ) Notice: Subject to any disclaimer, the term of this patent is extended or adjusted under 35 U.S.C. 154(b) by 211 days.

(21) Appl. No.: 10/934,145

(22) Filed: Sep. 2, 2004

(65) Prior Publication Data

US 2006/0043696 A1 Mar. 2, 2006

(51) Int. Cl.
*A63C 5/04* (2006.01)

(52) U.S. Cl. ..... 280/608

(58) Field of Classification Search ..... 280/809, 280/601, 607, 608, 609, 14.21
See application file for complete search history.

(56) References Cited

U.S. PATENT DOCUMENTS

| | | | | | |
|---|---|---|---|---|---|
| 1,723,693 | A | * | 8/1929 | Froholm | 280/608 |
| 2,157,325 | A | * | 5/1939 | Currier | 280/608 |
| 3,063,728 | A | * | 11/1962 | Patterson | 280/608 |
| 3,637,226 | A | * | 1/1972 | Simon | 280/608 |
| 3,871,671 | A | * | 3/1975 | Bildner | 280/608 |
| 4,083,577 | A | * | 4/1978 | Ford | 280/609 |
| 4,601,488 | A | * | 7/1986 | Jarrett | 280/810 |
| 5,083,810 | A | * | 1/1992 | Minidis | 280/608 |
| 5,810,370 | A | * | 9/1998 | Covert et al. | 280/14.24 |
| 6,062,585 | A | * | 5/2000 | Hess | 280/608 |
| 6,352,268 | B1 | * | 3/2002 | Peart | 280/14.21 |
| 6,758,487 | B1 | * | 7/2004 | Stucki | 280/608 |
| 2005/0104329 | A1 | | 5/2005 | Ellison | |

FOREIGN PATENT DOCUMENTS

| | | | |
|---|---|---|---|
| DE | DT 24 27 195 A1 | * | 1/1976 |
| DE | 299 22 137 | * | 5/2000 |
| EP | 0087089 A2 | * | 2/1983 |

* cited by examiner

*Primary Examiner*—Russell D. Stormer
*Assistant Examiner*—Bridget Avery
(74) *Attorney, Agent, or Firm*—Black Lowe & Graham, PLLC

(57) ABSTRACT

The invention disclosed herein provides a replaceable edge cassette for skis or a snowboard. The skis have a top, a base, a core, two sides, and edges along the sides of the base. The cassette includes an edge portion removably secured adjacent the base of the ski. The edge portion has an attachment portion for securing the edge portion to the ski and a peripheral portion for contact with the surface to be ridden. The cassette includes a sidewall portion secured to the edge portion. A fastener is connectable through the sidewall portion to be secured to the ski adjacent the core. Base material is also secured beneath the removable edge portion so as to be adjacent the main base portion when the cassette is secured to the side of the ski. The edge cassette is removable and replaceable by removing the fasteners secured through the sidewall. The edge alone may also be separately replaceable by removing it from the sidewall portion.

22 Claims, 4 Drawing Sheets

SKI WITH REPLACEABLE EDGE

FIELD OF THE INVENTION

This invention relates generally to boards for gliding on snow and, more specifically, to skis and snowboards with partially replaceable edges and sidewalls.

BACKGROUND OF THE INVENTION

Skis and snowboards are typically constructed with a wood or foam core, composite layers (usually fiberglass) above and below the core, a polyethylene base (such as "P-Tex"), an ABS top sheet and sidewalls, and steel edges. The steel edges include an exposed corner portion, which is rectangular in cross section, and ears extending from the corner section to be secured between the base and the core of the ski. The ears include T-shaped extensions, as shown in FIG. 1, that allow the composite material to hold the edge in place. Thus, once the ski is molded, the edges are non-removably secured to the body of the ski (note that the discussion referencing a "ski" applies equally to a snowboard unless otherwise noted).

If a ski is damaged, such as with a scrape to the base, it is normally repairable at a reasonable cost. The base can be repaired by base welding, patching, or by the simple addition of melted P-Tex into the damaged area. However, if the damage includes a significantly bent edge or a broken edge, the repair is much more difficult. Often the ski must simply be replaced (both skis would be replaced together, as they need to be paired).

Bent and/or cracked edges have become more common as skiers spend more and more time doing tricks in the parks and pipes and even in off-piste terrain. The ski edges are often slid over obstacles, such as benches, rails, table tops, trees, stumps, and walls. Such maneuvers can easily damage an edge and require replacement of the pair of skis. Even when skiing without performing stunts, ski edges may be blown when a rock is hit. This occurrence is also increasing in frequency due to the opening of boundaries and more off-piste skiing or skiing in areas where unmarked obstacles exist. Cracks often occur due to the hardness of the steel required to keep a sharp edge.

Attempts to solve the bent and cracked-edge problems have focused on providing thicker edges on skis intended to be used in terrain parks. The thick edge is more difficult to bend. However, making edges thick enough to withstand most bends may overly increase the stiffness of the ski underfoot (where damage typically is focused). Furthermore, damage from scrapes and other wear on the edges will still accumulate, requiring ski replacement. Damage to the sidewall may also occur with damage to an edge. If the sidewall is damaged the edge has less to support it to keep it strong and properly in place. Replacing a portion of a sidewall is also difficult and, thus, costly.

Another problem with ski edges is associated with the sharp corner the edge provides. The corners help hold the ski from skidding on ice or hard-packed snow. However the sharp corner can also cause increased friction when ground on obstacles, such as a pipe or box rail, during skiing. The friction can heat the steel to lead to excessive hardness and cracking. The sharp edge tends to "grab" on discontinuities. This mars and distorts the edge, and excessively damages the surface ridden. The square edge also catches on the metal, wood, plastic, and concrete rails, and wears out the rails. The edges also catch when attempting to pivot the skis or switch from forwards to backwards on the skis.

Thus, an unmet need exists to better address the damage done to skis by obstacles skied over or upon. The solution should be less costly than replacing skis. It should also be a solution that could be optionally handled by the consumer, without extensive recourse to a dealer or manufacturer.

SUMMARY OF THE INVENTION

The present invention comprises a board, such as a ski or snowboard, for sliding on snow. The board includes a top, a base, a first edge, a removable edge assembly, and an anchor member. The base is positioned below the top. The first edge is secured adjacent the base. The removable edge assembly is secured adjacent the base and adjacent the first edge. The edge assembly includes a removal fastener. The anchor member is adjacent the base and receives the removal fastener to removably and replaceably secure the edge assembly.

In accordance with a preferred aspect of the invention, the removable edge assembly includes a sidewall portion and an edge portion secured to the sidewall portion. In this embodiment, the removal fastener extends through the sidewall portion above the edge portion. The edge assembly includes a base plug secured adjacent the edge portion. The edge portion also includes steel having a peripheral portion and an inner portion secured to the sidewall portion. The base plug is secured to the inner portion of the edge portion. In accordance with another aspect of the invention, the edge portion is removably and replaceably secured to the sidewall portion. The edge assembly further includes an edge fastener secured between the edge portion and the sidewall portion.

In accordance with yet another aspect of the invention, the edge portion is constructed of a different material from the sidewall portion, the edge portion being fixed to the sidewall portion. In one preferred embodiment, the sidewall portion is secured to the edge portion by molding the sidewall portion about at least a part of the edge portion.

In accordance with additional aspects of the invention, the board includes a sidewall secured between the top and the base with an anchor being secured within the sidewall. The anchor member includes an insert for threaded engagement with the removable fastener. The base plug includes a fastener secured to the edge portion. In one preferred embodiment, the sidewall portion includes a lower portion with a base recess. The removable edge assembly includes the base plugs secured within the base recess arranged adjacent to the base.

In accordance with another preferred aspect of the invention, the sidewall portion includes the portion outward of the base plug. Preferably, the sidewall portion is constructed of a thermoplastic material.

The present invention also preferably includes a replaceable edge cassette for a surface sliding board. The board has a top, a base, a core, two sides, and edges along the sides of the base. The cassette comprises an edge portion removeably secured adjacent the base of the sliding board and a fastener for securing the edge portion to the board. The edge portion has an attachment portion for securing the edge portion to the board and a peripheral portion for contact with the surface to be ridden.

In accordance with further aspects of this preferred embodiment, a sidewall portion is provided. This sidewall portion is secured to the edge portion. The sidewall portion is securable to the board adjacent the core. Preferably, the fastener is securable to the core. An edge fastener is also preferably provided to secure the edge portion to the sidewall portion.

A base plug is secured to the edge portion beneath the attachment portion of the edge portion.

The invention also comprises a method of replacing an edge portion of a sliding board having a top, a base, a core, two sides, and edges. The method includes the steps of providing an edge cassette having an edge portion and a fastener, loosening the fastener, removing the cassette from the side of the sliding board, positioning another edge cassette, and securing the fastener. The fastener secures the edge portion to the sliding board. The edge cassette is positioned adjacent the side of the sliding board.

Preferably, the method includes the step of providing an edge cassette having a sidewall, the edge portion being attached to the sidewall. The sidewall is attached to the sliding board with the fastener. A base plug is also preferably secured to the bottom of the edge portion.

In yet another preferred embodiment of the invention, a board for sliding on snow is provided. The board has a mid portion, a forward portion, and a rearward portion. The board comprises a top, a base, a core, and a mid-edge portion. The base is positioned below the top. The core is positioned between the base and the top. The mid-edge portion runs along the mid portion of the board. The mid edge portion includes a mounting portion secured above the base and an outer portion. The outer portion has a lower corner for contact with the snow. The lower corner includes a rounded portion.

In a preferred aspect of this embodiment, the mid-edge portion is held by a removable cassette. The removable cassette is securable adjacent the base at the mid portion of the board. The cassette includes a sidewall and a fastener, the fastener being removably securable to the core. Preferably, the base includes a cassette portion and a main portion. The cassette portion is secured beneath the mid-edge portion. The main portion of the base is under the core, adjacent the cassette portion.

The many preferred aspects of the invention provide several advantages to the user of the board to overcome the drawbacks encountered in the prior art. For example, the rounded radius edge under the mid portion of the ski allows easier side sliding at the portion of the ski that receives the skier's foot, and thus the most force on the ski. This construction aids skiers who ski in variable mountain and natural terrain conditions or in terrain parks and hit obstacles while sliding sideways. The radius steel edge allows the ski to slide easier without catching an edge. The radius reduces friction, thus helping keep the steel from changing its hardness and cracking. The rounded radius also helps to prevent marring and distortion of the steel edge. The rounded edge also does not grip the metal, wood, plastic, and concrete rails: allowing the ski to slide without catching like a square edge. Skiers may roll their ankles placing the skis on edge when sliding the rail. The rounded edges help the skis slide more smoothly. It also causes less wear and tear to the rails and affords less maintenance. The skis pivot easier, the edge grabs less, allowing the skier to switch from going forward to backward and vice versa. Thus, the skis are more maneuverable while sliding rails and boxes, making it easier to spin 180 degrees or more while staying in contact with the rail. The removal assembly (whether just the steel edge or a full edge and sidewall cassette) allows the user to remove the cassette or the steel edge material when damage occurs to the edges. It allows the user to change the out damaged edges due to rails and rocks. It also allows the user to change the out edges for rounded edges or sharp edges depending on the terrain to be skied.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

The construction and advantages of the present invention will be more clearly understood by reference to the following description of the preferred embodiments and by reference to the attached drawings referred to herein.

Figure 1:
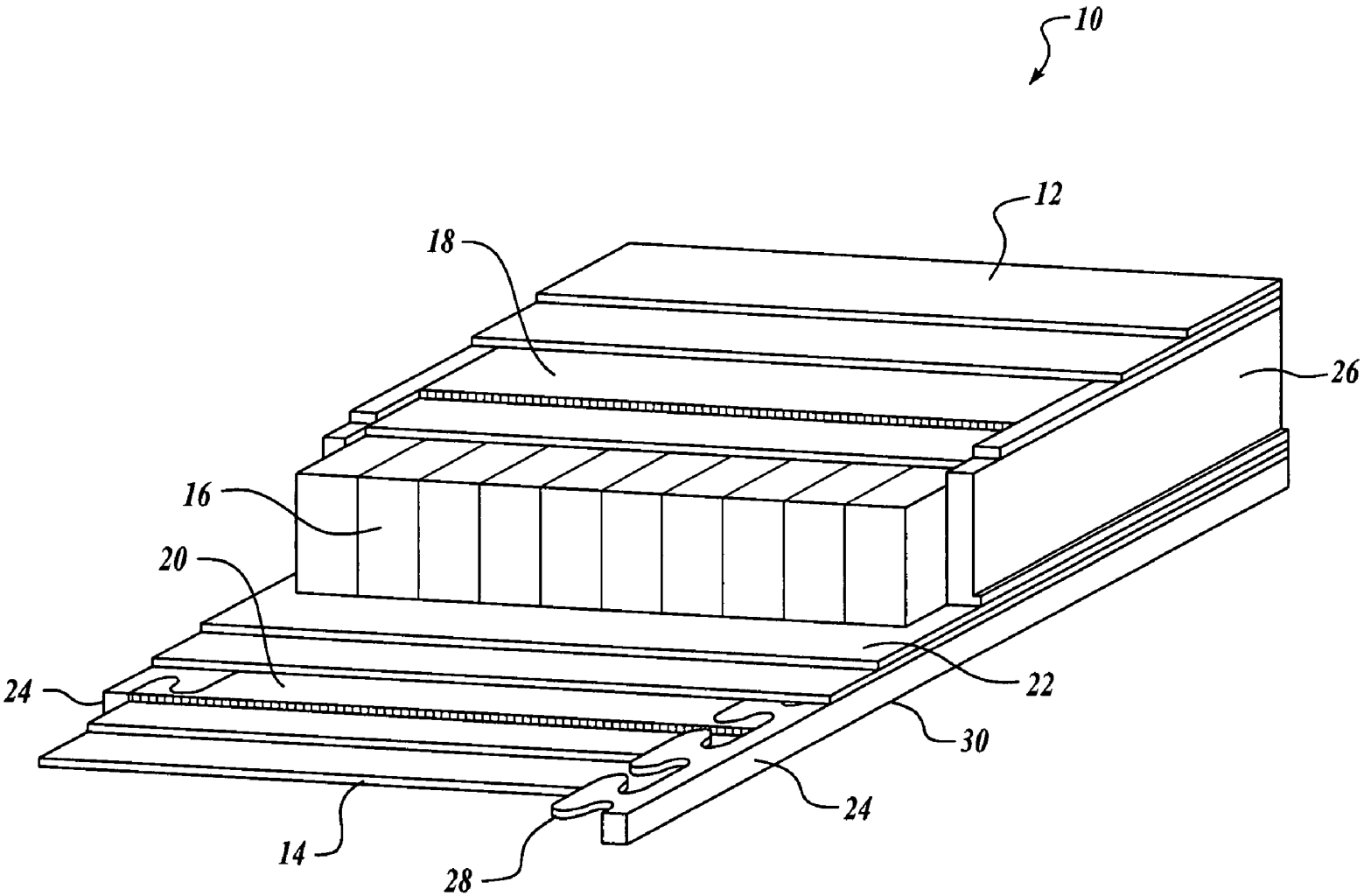
FIG. 1 is a cut-away of standard laminate ski construction.

FIG. 1 illustrates a cut-away of a typical prior-art ski construction. This particular illustration shows a laminate construction of a ski 10. The ski includes a top sheet 12, a base 14 and a core 16 sandwiched one on top of the other. An upper composite layer 18 may be situated between top sheet 12 and core 16. A separate composite layer would typically be fiberglass or other composites in a resin matrix as is commonly known in the art. Other layers between core 16 and top sheet 12 are also possible such as metal sheets 22. A lower composite layer 20 is also provided between base 14 and core 16. Top sheet 12 may be of a plastic material such as ABS. Face 14 is typically constructed with a polyethylene material. Core 16 may be constructed with foam, wood or other materials. FIG. 1 illustrates core 16 with a laminated wood material.

An edge 24 is secured above base 14, typically intertwined with and above lower composite layer 20. A sidewalk 26 also extends upward above edge 24 adjacent core 16 to top sheet 12 or one of the intermediate layers between top sheet 12 and core 16. Sidewall 26 is typically constructed of an ABS material.

Edge 24 includes ears 28 that project inwardly toward the center of the ski basically in a plane parallel to the plane of base 14. The gaps between these ears allow the composite layer 20 with its resin to form a mechanical bond in the gaps to hold edge 24 in place. Edge 24 also includes an outer portion 30 that has a squared edge for cutting into snow and ice for a secure grip while skiing.

The construction shown and described with regard to FIG. 1 is a standard ski construction that those skilled in the art will recognize. Many variations thereto have also been used with many of the same elements, such as metal edges, base material, composite layers, top sheets and cores. For example, torsion box constructions or cap constructions are also well known.

The remaining figures illustrate a ski that includes somewhat of a standard construction in the fore and aft portion of the ski while the mid-portion of the ski includes an edge cassette 32 that is removable from the main body of the ski and replaceable. In order to accommodate edge cassette 32 the standard ski construction is reduced in width in the mid portion such that recesses are provided in the sides of the ski 10 into which edge cassettes 32 are secured. Edge cassettes 32 preferably extend along approximately a third of the length of ski 10 in the region of the ski that would be adjacent the boot bindings. Thus, this is the area of the ski that receives the most direct force from the skier and would be the portion of the ski which is underfoot.

Figure 3:
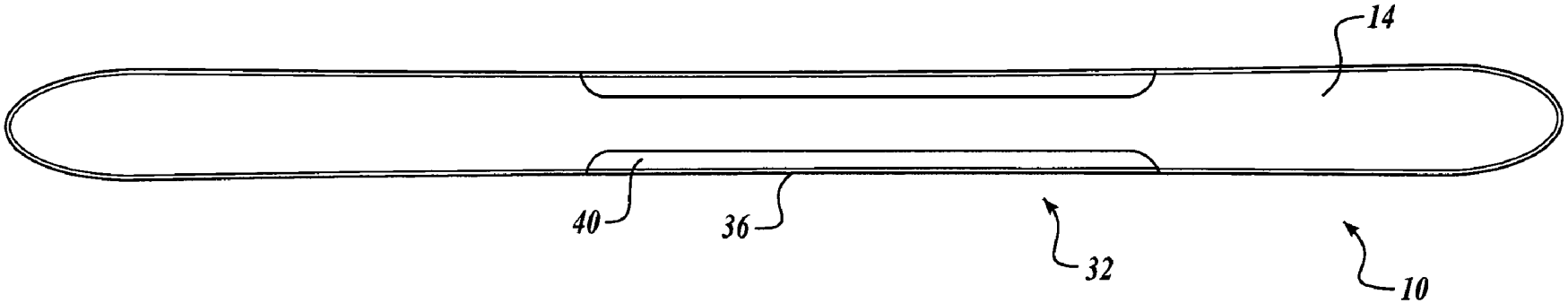
FIG. 3 is a bottom view of the ski.
Figure 4:
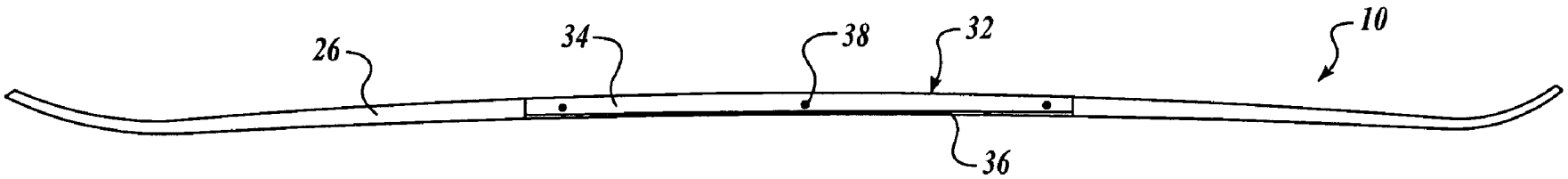
FIG. 4 is a side view of the ski showing the edge cassette in place.
Figure 5:
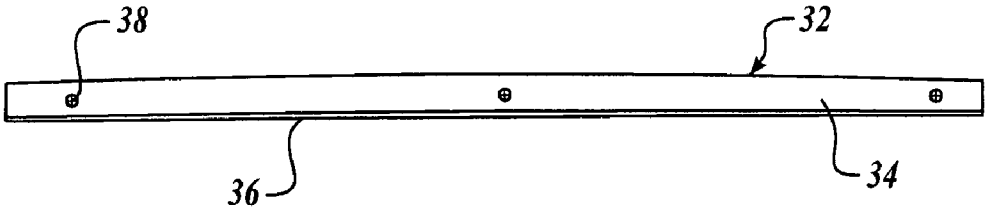
FIG. 5 is a side view of the edge cassette separate from the ski.

As seen in FIGS. 3 and 4, edge cassette 32 includes a cassette sidewall 34 and a cassette edge 36. Cassette sidewall 34 is secured on the outer side of edge cassette 32 so as to be along the side of the ski when assembled adjacent sidewall 26 that extends in the fore and aft portion of the ski. Cassette edge 36 is secured beneath cassette sidewall 34 so as to lie in the mid-portion of the ski for a continuous edge extending from edges 24 in the fore and aft portions of the ski to be adjacent thereto. Edge cassette 32 is secured within the recesses in the sides of ski 10 with cassette fasteners 38. In the preferred embodiment illustrated, three cassette fasteners 38 secure edge cassette 32 through openings within cassette sidewall 34 with fasteners passing into the main body of the ski. Inserts may be employed within core 16 or fasteners 38 may simply be anchored directly to core 16. Other anchor arrangements may be used and held within the main body of ski 10. Thus, fasteners 38 are preferably bolts that are threaded and include heads that may be turned to fasten the threads within a threaded anchor held within ski 10. A section of base material may be used to form a base plug 40 that is secured to the bottom of edge cassette 32 below sidewall 34 and ears 28 prime of cassette edge 36.

Figure 6:
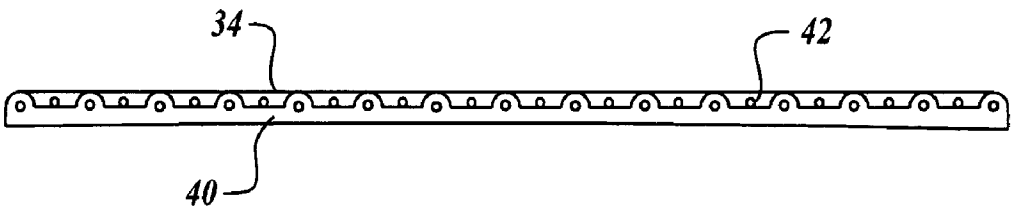
FIG. 6 is a bottom view of the edge cassette without the edge and base material in place.

FIG. 6 illustrates a bottom view of cassette sidewall 34 provided with an edge recess 40 into which the ears of cassette edge 36 may be secured. The particular ears 28 preferably used with cassette edge 36 include apertures therein that may be secured over a molded recess with projections to fit within the apertures. The ears may be of any suitable shape (e.g., T-slot, rounded, etc.) to retain them onto cassette sidewall 34, sidewall 26, or any other part of ski 10 to which they may be secured in a particular embodiment. Preferably, the ears have openings or holes to accept fasteners for replaceable securement.

Also shown in the bottom view of FIG. 6 are the base plug apertures 42 into which plug fasteners 44 may be secured to hold a base plug 40 in place beneath ears 28 and cassette sidewall 34. Alternate means of securing cassette edge 36 and base plug 40 may be employed. For example, if the entire assembly is to be used and replaced as a unit there may be no need for removal fasteners such that adhesive bonding or chemical bonding may be employed to secure the materials together. Further discussion of alternate ways of interconnecting these elements will be discussed below in connection with FIG. 7.

Sidewall 34 is preferably constructed of ABS or another thermoplastic material. Alternatively, sidewall 34 is constructed of other materials, in one embodiment metal is used in at least a portion of sidewall 34.

Figure 2:
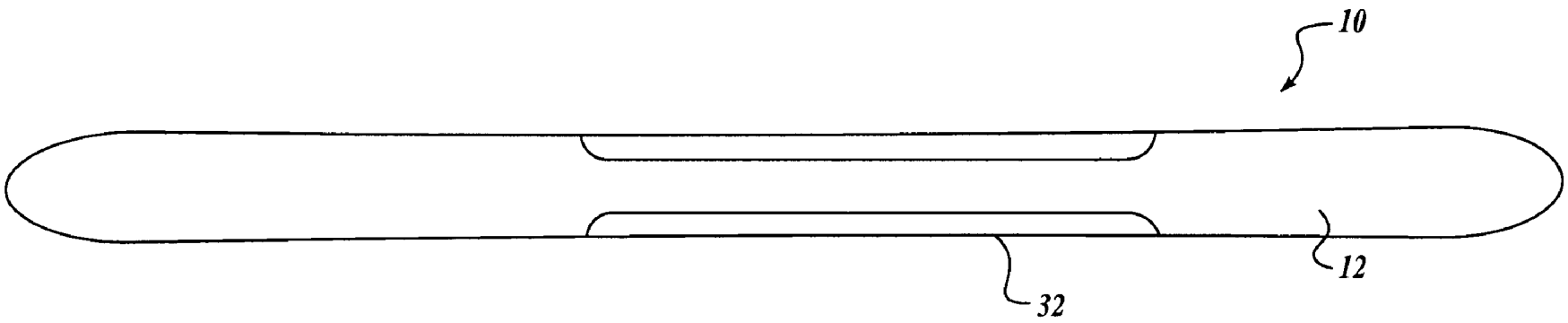
FIG. 2 is a top view of the ski of the present invention.

The width of cassette sidewall 34 is preferably between 5 and 8 millimeters but could be more or less depending upon the specific construction desired. For example, in an alternate preferred embodiment, the width of cassette sidewall 34 is only 2 millimeters and ears 28 prime overlap not only cassette sidewall 34 but extend beneath a recessed portion of the main body of ski 10 adjacent cassette sidewall 34. In this embodiment, the recesses in the sides of ski 10, such as those shown in FIG. 2, do not need to be very extensive on the top side with appropriate recesses for edge ears 28 prime on the bottom side.

Base plug 40 is preferably constructed with an ABS material or another thermoplastic material such as Delrin or Hytrill (both trademarks of DuPont). Alternatively, base plug 40 is constructed of metal. In one embodiment base plug 40 is a metal extension of cassette edge 36.

Figure 7C:
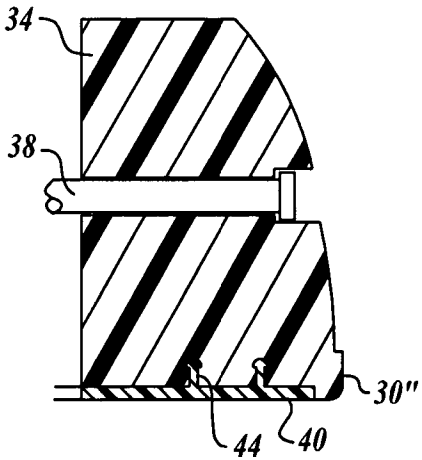
FIGS. 7*a*-7*f* are cross-sectional views of the edge cassette of the present invention.
Figure 7B:
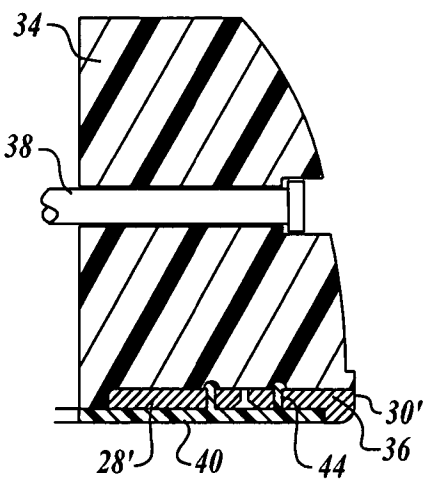
Figure 7A:
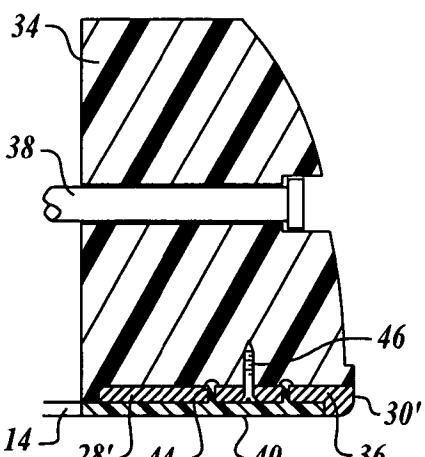

FIGS. 7*a*-7*d* illustrate various details of construction of different preferred embodiments of the invention. FIG. 7*a* illustrates a basic construction with a cassette fastener 38 extending through cassette sidewall 34 to be anchored within core 16 or an alternate anchor structure held adjacent to or within core 16. The head of cassette fastener 38 is secured within a recess in the outer wall of cassette sidewall 34. The outer wall of cassette sidewall 34 may have a rounded slope or may extend vertically depending on the aesthetics desired in the ski and on some performance criteria. Cassette edge 36 is secured with edge fastener 46 to the underside of cassette sidewall 34 through a hole in an ear 28 prime of cassette edge 36. Outer portion 30 prime of cassette edge 36 includes a rounded radius for ease of sliding and grinding with reduced friction, reduced edge marring and reduced damage to rails or other objects on which the skier may grind or slide. Apertures are also provided within ears 28 and adjacent ears 28 within cassette sidewall 34 for plug fasteners 44 of base plug 40. These fasteners allow base plug 30 to be secured in place beneath cassette edge 36. In this embodiment, the removal of base plug 40 is required in order to access edge fastener 46 to remove cassette edge 36 from cassette sidewall 34. Thus, if damage occurs to outer portion 30 prime of cassette edge 36 the entire cassette assembly may be removed by loosening cassette fastener 38 and replacing the entire assembly. Alternatively, the user may simply wish to replace cassette edge 36 and then has the further option of replacing base plug 40. Note that base plug 40 when installed sits adjacent base 14 for a smooth transition between the two.

In alternate embodiments portion 30' of cassette edge 36 may have a square edge for carving. Thus, edge cassette 32 may be swapped with various other edge cassettes depending on the type of skiing that the skier wishes to do.

Referring to FIG. 7*b*, cassette edge 36 may be molded directly to cassette sidewall 34 alleviating the need for a separate edge fastener 46. In this instance, cassette edge 36 would simply be placed in the mold when the thermoplastic material is shot into the mold. In this instance, special edge apertures 48 are provided into which material may flow to bind cassette edge 36 to cassette sidewall 34.

Referring to FIG. 7*c*, a separate metal or other material edge may be omitted entirely in favor of simply having the material of cassette sidewall 34 also function as the outer edge 30 double prime of edge cassette 32. In this instance, base plug 40 is fastened directly to cassette sidewall 34. This embodiment may be preferable when excessive sliding or grinding is simply desired without steel edge grip or durability. This provides extra smoothness and sliding ability on rails, for example. The cassette sidewall material used may be a more durable material such as ultra-high molecular weight plastic. Delrin or other such materials may be used. The material may be machined, extruded or molded or formed in any other fashion. In fact, the entire cassette sidewall may be alternatively constructed of a metal whether a softer metal, such as aluminum, or a harder steel or other metal.

Figure 7F:
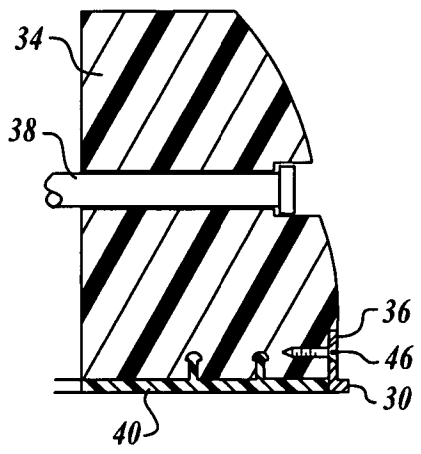
Figure 7E:
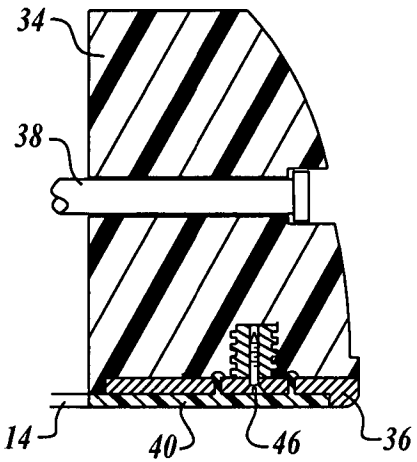
Figure 7D:
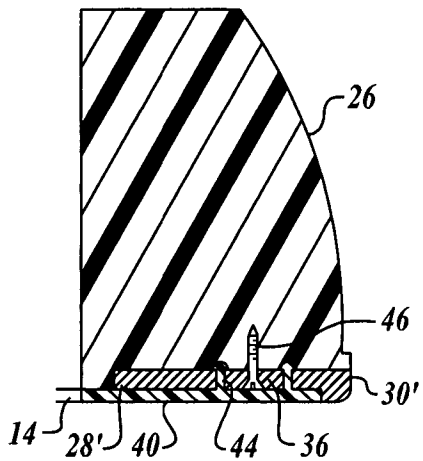

Referring to FIG. 7*d*, sidewall 26 is part of the main body of ski 10 and is not removable. Thus, in this instance, edge cassette 32 comprises cassette edge 36 and base plug 40. Edge fastener 46 is employed to removably secure the assembly to sidewall 26. An anchor, such as a threaded insert may be secured within sidewall 26 for securing edge fastener 46 and making repeated securement and removal of the assembly easier.

Referring now to FIG. 7*e*, an alternate embodiment of the invention employing a fastener insert 50 is disclosed. This embodiment is similar to that described above in connection with FIG. 7*a*. However, cassette sidewall 34 includes insert 50, preferably molded therein, to secure removable edge fastener 46. Insert 50 is comprised of metal and includes threads for engagement of fastener 46. The outer surface of insert 50 includes projections and recesses such that sidewall 34 engages firmly thereto as it is molded around insert 50. The outer dimensions of insert 50 are preferably at least somewhat non-cylindrical so as to better resist rotating relative to sidewall 34 as fastener 46 is tightened. Multiple fastener inserts 50 spaced along the length of sidewall 34 are preferably used where desirable to secure a fastener 46. In this embodiment, fastener 46 is a machine screw or bolt having threads that matingly engage insert 50. Thus, cassette edge 36 can be repeatedly removed and replaced within degradation of the engagement threads within sidewall 34.

FIG. 7*f* illustrates an alternate embodiment with a vertical edge ear 28 configuration. Rather than position edge ear 28 between base plug 40 and sidewall 34, edge ear 28 is secured with fastener 46 to the outer side of sidewall 34. In this embodiment, ear 28 is outwardly exposed. Outer portion 30 is positioned on the lower outer corner of ski 10 and abuts base plug 40. Replacement of cassette edge 36 is simplified, as base plug 40 does not need to be removed to gain access. Mating recesses within the outer wall of sidewall 34 hold ears 28 of edge 36 along with fasteners 46.

Numerous preferred and alternate embodiments have been discussed, these have been discussed in relation to a ski although a snowboard or other snow-riding device may work equally well with the present invention and are encompassed herein. Other materials may also be substituted. Fastening methods may be changed as well without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property is claimed are defined as follows:

1. A board for sliding on snow having a top, a core, and a base positioned below the top, the board having a forward portion, a mid portion, and a rearward portion, edges are fixedly secured adjacent the base along the forward portion and along the rearward portion, the edges being formed of a material harder than the base and core, the board comprising:

a) a recess extending transversely into the side of the board along the mid portion of the board; and b) an edge and sidewall assembly removably secured to the board within said recess in the mid portion of the board, said edge and sidewall assembly including a sidewall member and an edge member secured to the bottom of said sidewall member and in substantial alignment with the fixedly secured edges in the forward and rearward portions of the board, said sidewall member being removably fastened to said board between the top and the base within the recess, said edge and sidewall assembly being removable from the board as a unit.

2. The board of claim 1, further comprising a polyethylene base plug secured to the bottom of said sidewall member adjacent said edge member.

3. The board of claim 1, further comprising a removable fastener extending through said sidewall member into the mid portion of the board between the top and the base.

4. The board of claim 1, wherein said sidewall member extends vertically substantially the entire distance between the base and the top.

5. The board of claim 1, wherein said sidewall member extends laterally substantially the width of the recess along the mid portion of the board.

6. The board of claim 1, wherein said sidewall member extends forward to a position adjacent and substantially flush with the side of the forward portion of the board, and wherein said sidewall member extends rearward to a position adjacent and substantially flush with the side of the rearward portion of the board.

7. The board of claim 1, wherein said sidewall member is plastic and said edge member is metal, the two being fastened together.

8. The board of claim 1, wherein said sidewall member is a different material than said edge member.

9. The board of claim 1, wherein said edge member includes a lowermost outer corner having a rounded radius.

10. The board of claim 4, wherein the recess extends vertically through the entire ski.

11. The board of claim 7, wherein said sidewall member is removably fastened to said edge member.

12. The board of claim 8, wherein said sidewall member is secured to said edge member by molding said sidewall member about a least a part of said edge member.

13. A replaceable edge cassette for a surface sliding board, wherein the board has a top, a base positioned below the top, a core positioned between the base and the top, two sides, and edges along the sides of the base; at least one of the sides includes a recess along a mid portion thereof, the cassette comprising:

a) a sidewall member shaped for positioning within the recess, said sidewall member having a medial side, a lateral side, and a bottom, said sidewall member extending vertically through a substantial portion of the board with the medial side laterally adjacent the core;

b) an edge member secured to the bottom of said sidewall member adjacent the lateral side thereof, said edge member positioned to be in alignment with the edges of the board when said sidewall member is positioned in the recess, said edge member and said sidewall member forming an edge and sidewall assembly, wherein the edge and sidewall assembly is removeably securable to the board as a unit; and c) a fastener coupled to said sidewall member for securing the cassette within the recess of the board.

14. The cassette of claim 13, wherein said fastener is securable to the core.

15. The cassette of claim 14, further comprising an edge fastener to secure said edge member to said sidewall member.

16. The cassette of claim 15, further comprising a P-Tex base plug secured to said edge member.

17. A method of replacing an edge and sidewall assembly of a sliding board, the sliding board having a top, a base, a core, two sides, edges along fore and aft lower lateral portions of the sides, and at least one recess along a mid section of at least one side of the board, the method comprising:

a) providing an edge and sidewall assembly having: (i) a plastic sidewall member, (ii) a metal edge member secured to the sidewall member, and (iii) a fastener coupled to the sidewall member and secured to the mid portion of the board within the recess;

b) loosening the fastener from the board;

c) removing the edge and sidewall assembly as a unit from the recess;

d) positioning another edge and sidewall assembly within the recess of the board; and e) securing the fastener to the edge and sidewall assembly and board.

18. The method of claim 17, wherein the edge and sidewall assembly includes a base plug secured adjacent said edge member.

19. A board for sliding on snow, the board having a mid portion, a forward portion, and a rearward portion, the board comprising:

a) atop;

b) a base positioned below said top;

c) a core positioned between said base and said top; and d) a mid-edge portion running along the outer-most side mid-portion of the board, said mid-edge portion having a mounting portion secured above said base and an outer portion having a rounded corner on the lower, outer-most portion of the edge, wherein the mounting and outer portions of the mid-edge portion are removeably securable to the board as a unit.

20. The board of claim 19, further comprising a removable cassette securable adjacent said base at the mid portion of the board, said mid-edge portion being held by said removable cassette.

21. The board of claim 20, wherein said cassette includes a sidewall and a fastener, said fastener being removably securable to said core.

22. The board of claim 21, wherein said base includes a cassette portion secured beneath said mid-edge portion and a main portion under said core, adjacent said cassette portion and removable with said cassette portion.

* * * * *